US006323778B1

(12) United States Patent
Simpson et al.

(10) Patent No.: US 6,323,778 B1
(45) Date of Patent: Nov. 27, 2001

(54) ALARM SYSTEM FOR A TOILET SEAT

(76) Inventors: Roger W. Simpson; Ruth Simpson, both of 5350 Elmhurst Rd., Unit A, West Palm Beach, FL (US) 33417

( * ) Notice: Subject to any disclaimer, the term of this patent is extended or adjusted under 35 U.S.C. 154(b) by 0 days.

(21) Appl. No.: 09/754,916

(22) Filed: Jan. 5, 2001

(51) Int. Cl.[7] ..... G08B 21/00

(52) U.S. Cl. ..... 340/686.1; 340/384.4; 340/382.3; 340/573.1; 4/661; 200/61.62

(58) Field of Search ..... 340/686.1, 573.1, 340/384.4, 392.3; 4/661; 200/61.62

(56) References Cited

U.S. PATENT DOCUMENTS

| | | | | |
|---|---|---|---|---|
| D. 317,135 | | 5/1991 | Novack . | |
| 4,115,770 | * | 9/1978 | Kanazawa | 340/392.3 |
| 4,733,419 | * | 3/1988 | Nee | 340/686.1 |
| 4,849,742 | | 7/1989 | Warrington . | |
| 5,594,423 | | 1/1997 | East . | |
| 5,691,705 | | 11/1997 | East . | |
| 5,703,567 | | 12/1997 | Cleveland . | |
| 5,748,096 | * | 5/1998 | Kaufer | 340/686.1 |
| 5,870,015 | * | 2/1999 | Hinkel | 340/573.1 |
| 5,926,099 | * | 7/1999 | Unum | 340/686.1 |
| 6,028,520 | * | 2/2000 | Machre | 340/573.1 |

* cited by examiner

*Primary Examiner*—Daniel J. Wu

(57) ABSTRACT

An alarm system for signaling when the toilet seat of a toilet is left in an upright position in relation to a rim of the toilet bowl. The alarm system for a toilet seat includes a housing for mounting the alarm system to the toilet bowl. A sensor is provided for detecting when the toilet seat in the upright position in relation to the rim of the toilet. The sensor is mounted in the housing. Control circuitry is provided for controlling the alarm system. The control circuitry is mounted in the housing. A power supply is provided for providing power to the control circuitry. The power supply is removably mounted in the housing. A sound emitter is provided for audibly signaling that the toilet seat has been left in the upright position. The sound emitter is mounted in the housing.

12 Claims, 4 Drawing Sheets

ALARM SYSTEM FOR A TOILET SEAT

BACKGROUND OF THE INVENTION

1. Field of the Invention

The present invention relates to alarm systems and more particularly pertains to a new alarm system for a toilet seat for signaling when a toilet seat of a toilet is left in an upright position in relation to a rim of the toilet bowl.

2. Description of the Prior Art

The use of alarm systems is known in the prior art. More specifically, alarm systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,703,567; 5,926,099; 4,849,742; 5,691,705; 5,594,423; and Des. 317,135.

While these devices fulfill their respective, particular objectives and requirements, the aforementioned patents do not disclose a new alarm system for a toilet seat. The inventive device includes a housing for mounting the alarm system to the toilet bowl. A sensor is provided for detecting when the toilet seat is in the upright position in relation to the rim of the toilet. The sensor is preferably mounted in the housing. Control circuitry is provided for controlling the alarm system. The control circuitry is mounted in the housing. A power supply is provided for providing power to the control circuitry. The power supply is removably mounted in the housing. A sound emitter is provided for audibly signaling that the toilet seat has been left in the upright position. The sound emitter is mounted in the housing.

In these respects, the alarm system for a toilet seat according to the present invention substantially departs from the conventional concepts and designs of the prior art, and in so doing provides an apparatus primarily developed for the purpose of signaling when a toilet seat of a toilet is left in an upright position in relation to a rim of the toilet bowl.

SUMMARY OF THE INVENTION

In view of the foregoing disadvantages inherent in the known types of alarm systems now present in the prior art, the present invention provides a new alarm system for a toilet seat construction wherein the same can be utilized for signaling when a toilet seat of a toilet is left in an upright position in relation to a rim of the toilet bowl.

The general purpose of the present invention; which will be described subsequently in greater detail, is to provide a new alarm system for a toilet seat apparatus and method which has many of the advantages of the alarm systems mentioned heretofore and many novel features that result in a new alarm system for a toilet seat which is not anticipated, rendered obvious, suggested, or even implied by any of the prior art alarm systems, either alone or in any combination thereof.

To attain this, the present invention generally comprises a housing for mounting the alarm system to the toilet bowl. A sensor is provided for detecting when the toilet seat in the upright position in relation to the rim of the toilet. The sensor is mounted in the housing. Control circuitry is provided for controlling the alarm system. The control circuitry is mounted in the housing. A power supply is provided for providing power to the control circuitry. The power supply is removably mounted in the housing. A sound emitter is provided for audibly signaling that the toilet seat has been left in the upright position. The sound emitter is mounted in the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new alarm system for a toilet seat apparatus and method which has many of the advantages of the alarm systems mentioned heretofore and many novel features that result in a new alarm system for a toilet seat which is not anticipated, rendered obvious, suggested, or even implied by any of the prior art alarm systems, either alone or in any combination thereof.

It is another object of the present invention to provide a new alarm system for a toilet seat which may be easily and efficiently manufactured and marketed.

It is a further object of the present invention to provide a new alarm system for a toilet seat which is of a durable and reliable construction.

An even further object of the present invention is to provide a new alarm system for a toilet seat which is susceptible of a low cost of manufacture with regard to both materials and labor, and which accordingly is then susceptible of low prices of sale to the consuming public, thereby making such alarm system for a toilet seat economically available to the buying public.

Still yet another object of the present invention is to provide a new alarm system for a toilet seat which provides in the apparatuses and methods of the prior art some of the advantages thereof, while simultaneously overcoming some of the disadvantages normally associated therewith.

Still another object of the present invention is to provide a new alarm system for a toilet seat for signaling when a toilet seat of a toilet is left in an upright position in relation to a rim of the toilet bowl.

Yet another object of the present invention is to provide a new alarm system for a toilet seat which includes a housing for mounting the alarm system to the toilet bowl. A sensor is provided for detecting when the toilet seat in the upright position in relation to the rim of the toilet. The sensor is mounted in the housing. Control circuitry is provided for controlling the alarm system. The control circuitry is mounted in the housing. A power supply is provided for providing power to the control circuitry. The power supply is removably mounted in the housing. A sound emitter is provided for audibly signaling that the toilet seat has been left in the upright position. The sound emitter is mounted in the housing.

Still yet another object of the present invention is to provide a new alarm system for a toilet seat that reminds males to put the toilet seat down after using the toilet.

Even still another object of the present invention is to provide a new alarm system for a toilet seat that reduces the instances of females sitting on a toilet with the seat in an upright position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
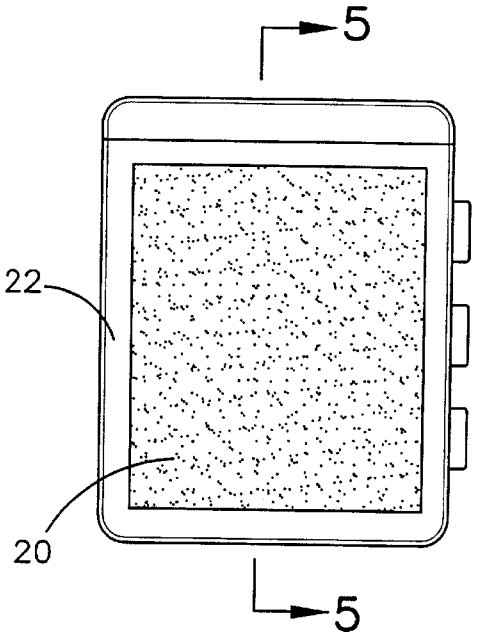
FIG. 2 is a schematic side view of the present invention taken along line 2—2 of FIG. 1 showing a securing member attached to a back surface of a back wall of the housing.
Figure 1:
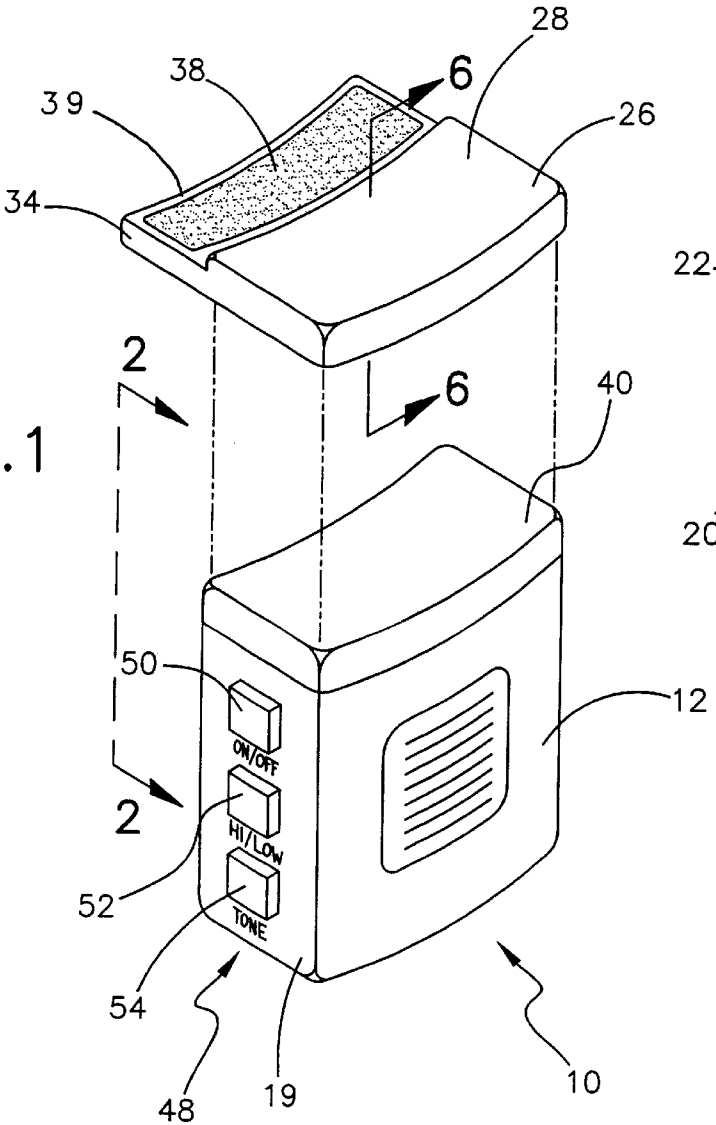
FIG. 1 is a schematic perspective view of a new alarm system for a toilet seat according to the present invention showing housing and a first contact positioned above the housing.
Figure 3:
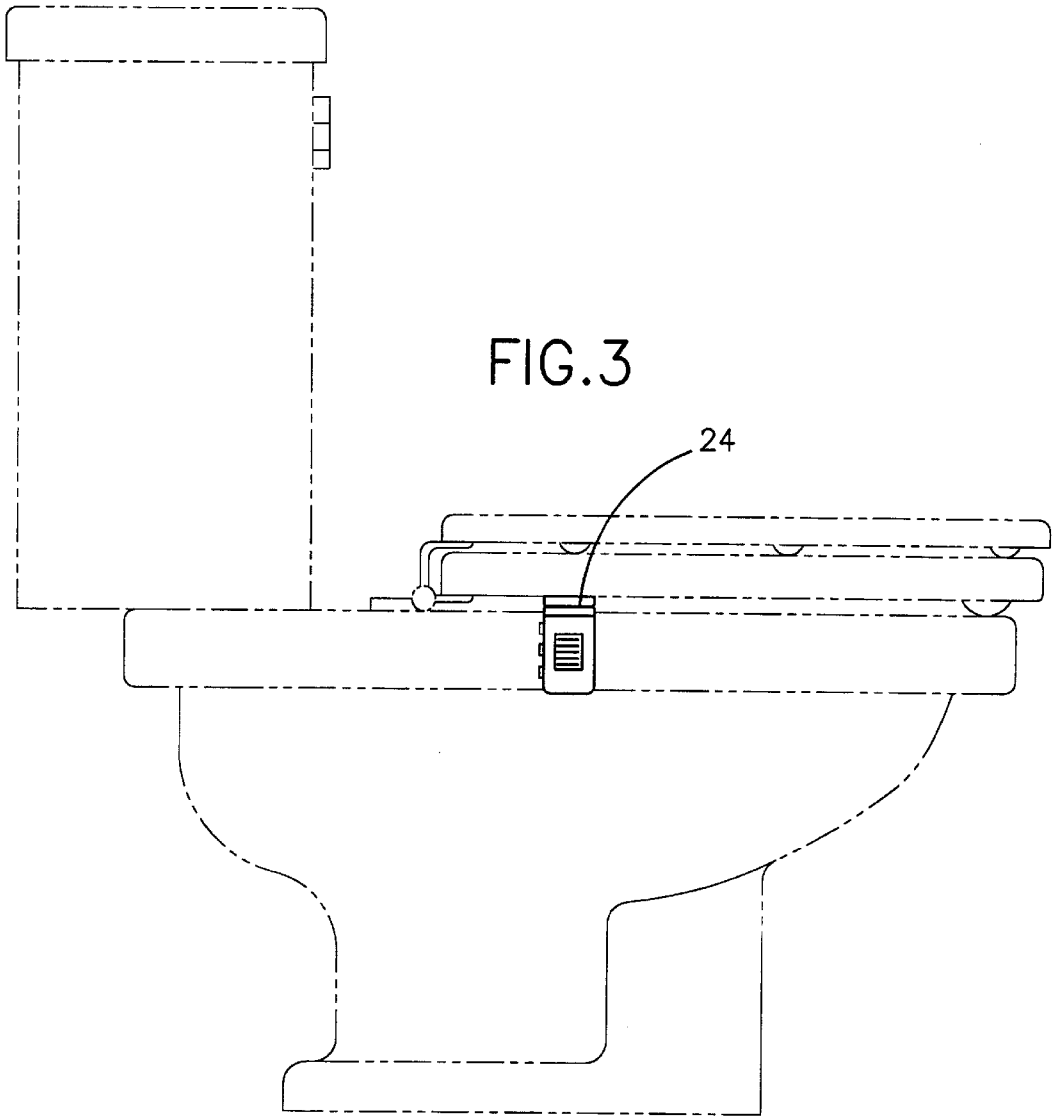
FIG. 3 is a schematic side view of the present invention showing th alarm system attached to a toilet with the seat in a horizontal position.
Figure 4:
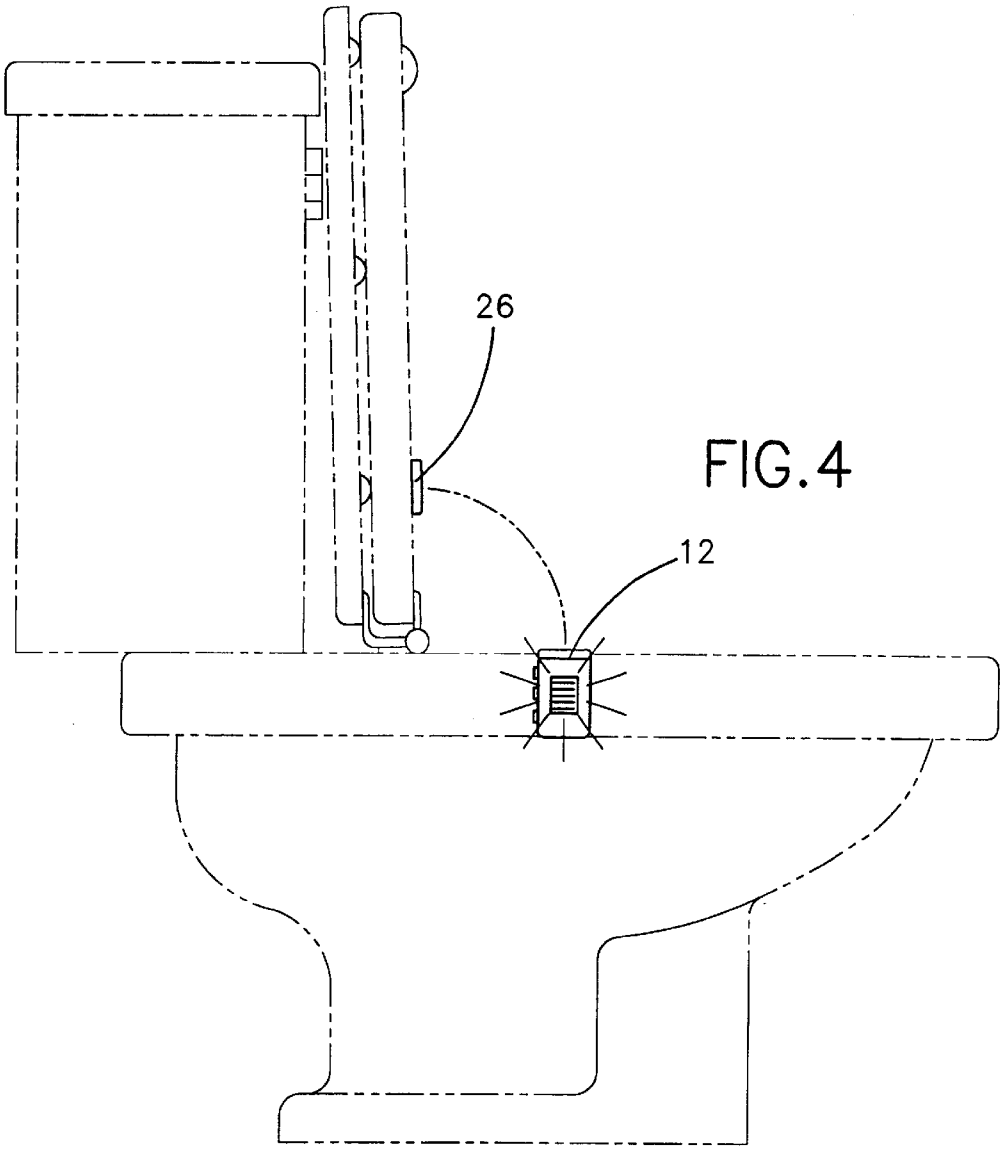
FIG. 4 is a schematic side view of the present invention showing the alarm system attached to a toilet wit the seat in an upright position.
Figure 5:
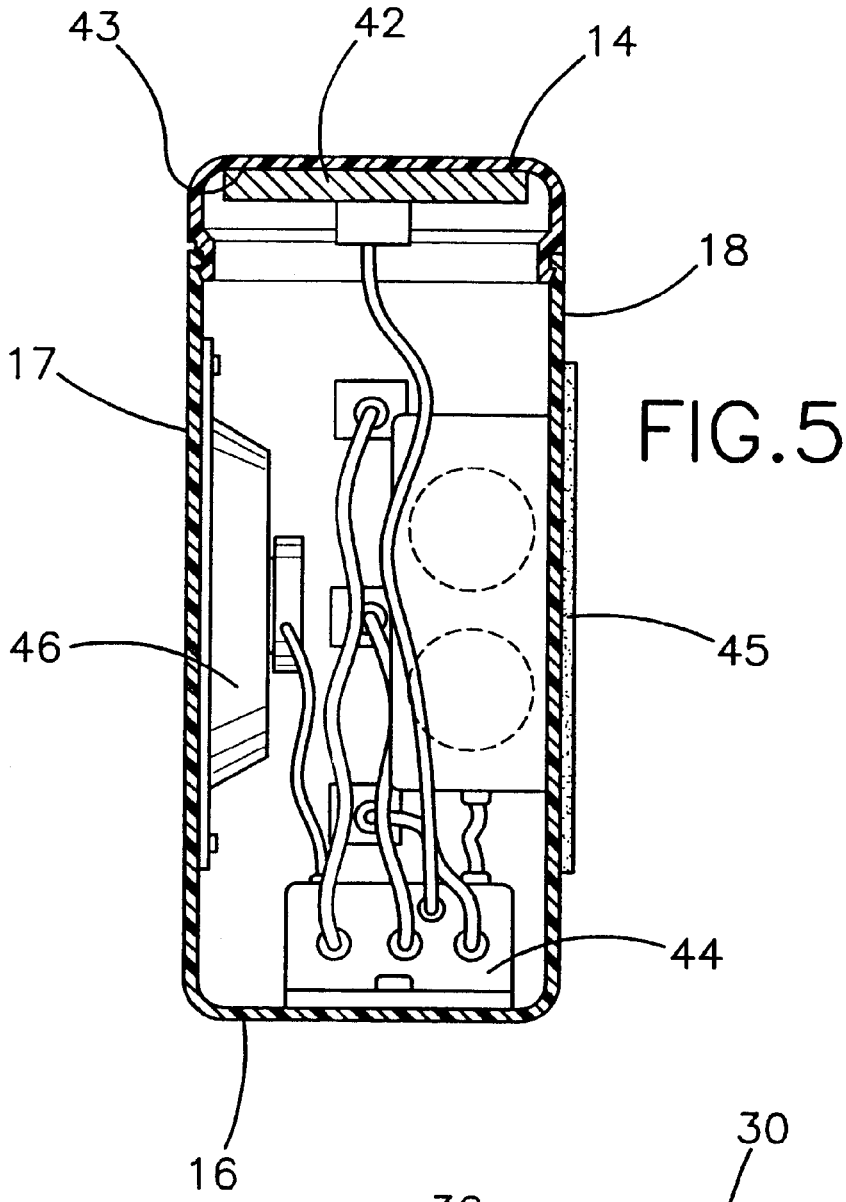
FIG. 5 is a schematic cross-sectional view of the present invention taken along line 5—5 of FIG. 2 showing a sound emitter, a power supply, control circuitry mounted in the housing.

With reference now to the drawings, and in particular to FIGS. 1 through 6 thereof, a new alarm system for a toilet seat embodying the principles and concepts of the present invention and generally designated by the reference numeral 10 will be described.

As best illustrated in FIGS. 1 through 6, the alarm system for a toilet seat 10 generally for sounding an alarm when a toilet seat of a toilet is left in an upright position in relation to a rim of the toilet bowl comprises a housing 12. The housing 12 is provided for mounting the alarm system 10 to a toilet bowl. The housing 12 has a top wall 14 and a bottom wall 16. A front wall 17, a back wall 18 and a pair of side walls 19 extend between the top 14 and bottom walls 16 of the housing 12. The housing 12 may comprise a substantially rigid material such as, for example, a plastic or metal material.

As illustrated in FIG. 2, a fastening means 20 may be provided for fastening the housing 12 to an outer surface of the toilet bowl. The fastening means 20 may be attached to an outer surface 22 of the back wall 18 of the housing 12. The fastening means may comprise a substantially adhesive material such as double-sided tape.

A sensor 24 is provided for detecting when the toilet seat is in the upright position. The sensor 24 preferably comprises a first contact 26 that is attachable to a lower surface of the toilet seat. The first contact 26 may comprise a plate 28 for contacting the top wall 14 of the housing 12. The plate 28 has an upper surface 30 and a lower surface 31. A peripheral edge 32 of the plate 28 extends between the upper 30 and lower 31 surfaces of the plate 28. The plate 28 may comprises a substantially rigid material such as, for example, a plastic or metal material.

A protruding member 34 may be provided that extends away from the peripheral edge 32 of the plate 28. The protruding member 34 preferably has a length equal to a length of the plate 28. The protruding member 34 preferably has a thickness approximately half a thickness of the plate 28.

Figure 6:
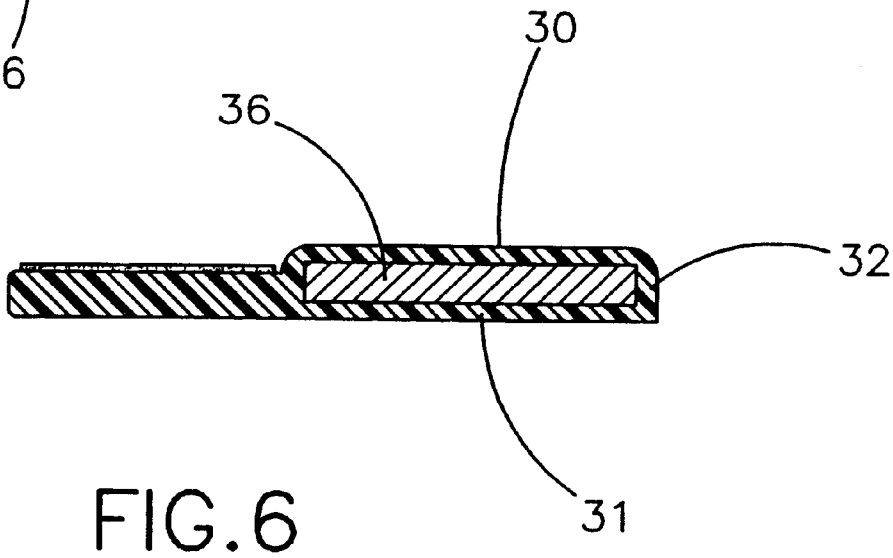
FIG. 6 is a schematic cross-sectional view of the present invention taken along line 6—6 of FIG. 1 showing a first contact having first magnetic member mounted therein.

As illustrated in FIG. 6, a first magnetic member 36 may be mounted in the plate 28 between the upper 30 and lower surfaces 31 of the plate 28. The first magnetic member 36 preferably has a length approximately equal to a length of the plate 28. The first magnetic member 36 is preferably position in the plate such that its magnetic field extends outwardly away from the plate.

A securing means 38 may be provided for securing the protruding member 34 to a lower surface of the toilet seat. The securing means 38 may be attached to an upper surface 39 of the protruding member 34. The securing means 38 may comprise an adhesive material such as double-sided tape.

The sensor 24 also preferably comprises a second contact 40 that is mounted on the housing 12. The second contact 40 preferably comprises a second magnetic member 42 that is attached to a lower surface 43 of the top wall 14 of the housing 12. The second magnetic member 42 may be in magnetic communication with the first magnetic member 36 when the toilet seat is in a horizontal position in relation to the rim of the toilet.

In one embodiment, the sensor 24 detects when the toilet seat is left in the upright position. When the toilet seat is left in the upright position, the first magnetic member 36 is positioned away from the second magnetic member 42 breaking magnetic communication between the first 36 and second 42 magnetic members.

Control circuitry 44 is provided for controlling the alarm system 10. The control circuitry 44 is electrically connected to the second contact 40. The control circuitry 44 interprets the break in communication between the first 36 and second 42 magnetic members. A power supply 45 is provided for providing power to the control circuitry 44. The power supply 45 is removably mounted in said housing 12.

A sound emitter 46 is provided for audibly signaling that the toilet seat has been left in the upright position. The sound emitter 46 is preferably mounted in the housing 12 and positioned generally adjacent to the front wall 17 of the housing 12. The sound emitter 46 is electrically connected to the control circuitry 44. The sound emitter 46 may comprise a speaker.

A plurality of switches 48 is provided for controlling the alarm system 10. Each of the switches 48 is mounted in the housing 12 and extends through one of the side walls 19 of the housing 12. The plurality of switches 48 may comprise a power switch 50 for providing power from the power supply 45 to the control circuitry 44. The power switch 50 is electrically connected to the control circuitry 44.

The plurality of switches may also include a volume switch 52 for controlling the volume of the sound emitter 46. The volume switch 52 is electrically connected to the control circuitry 44.

A tone switch 54 may be provided for controlling the type of tone emitted from the sound emitter 46. The tone switch 54 is electrically connected to the control circuitry 44.

In use, the sound emitter 46 emits an audible alarm when the toilet seat is moved from a horizontal position, in relation to the rim of the toilet, to an upright position. The upright position breaks the magnetic communication between the first magnetic member 36 and the second magnetic member 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An alarm system for sounding an audible alarm when a toilet seat of a toilet is left in an upright position in relation to a rim of the toilet bowl, said system comprising:

a housing for mounting having a top wall and a bottom wall, a front wall, a back wall and a pair of side walls extending between said top and bottom walls of said housing;

a fastening means for fastening said housing to an outer surface of the toilet bowl;

an alarm assembly comprising:

a connecting sensor for detecting when the toilet seat is in the upright position, said connecting sensor having a first contact being attachable to a lower surface of the toilet seat and a second contact being mounted in said housing, said connecting sensor detecting the toilet seat being left in the upright position when said first and said second contacts are not in contact with each other;

control circuitry for controlling the alarm system, said control circuitry being mounted in said housing and activating an alarm when said first and said contacts are not in contact with each other;

a power supply for providing power to said control circuitry, said power supply being removably mounted in said housing; and a sound emitter for audibly signaling that the toilet seat has been left in the upright position, said sound emitter being mounted in said housing.

2. The alarm system of 1, wherein said fastening means is attached to an outer surface of a back wall of said housing.

3. The alarm system of claim 1, wherein said first contact comprises:

a plate for contacting the top wall of the housing;

a protruding member extending away from a peripheral edge of said plate; and a first magnetic member being mounted in said plate and being positioned between said upper and lower surfaces of said plate.

4. The alarm system of claim 1, wherein said second contact comprises:

a second magnetic member being attached to a lower surface of a top wall of said housing.

5. The alarm system of claim 4, wherein said second magnetic member is electrically connected to said control circuitry.

6. The alarm system of claim 3, additionally comprising:

a securing means for securing said protruding member to a lower surface of the toilet seat, said securing means being attached to an upper surface of said protruding member.

7. The alarm system of claim 1, wherein said control circuitry is electrically connected to said second contact.

8. The alarm system of claim 1, additionally comprising:

a plurality of switches for controlling said alarm system, each of said switches being mounted in said housing.

9. The alarm system of claim 8, wherein said plurality of switches comprises a power switch for providing power from said power supply to said control circuitry.

10. The alarm system of claim 8, wherein said plurality of switches comprises a volume switch for controlling the volume of said sound emitter.

11. The alarm system of claim 8, wherein said plurality of switches comprises a tone switch for controlling the type of tone emitted from said sound emitter.

12. An alarm system for sounding an alarm when a toilet seat of a toilet is left in an upright position in relation to a rim of the toilet bowl, said system comprising:

a housing for mounting said alarm system to the toilet bowl, said housing having a top wall and a bottom wall, a front wall, a back wall and a pair of side walls extending between said top and bottom walls of said housing, said housing comprising a substantially rigid material, said top wall comprising a substantially rigid material;

a fastening means for fastening said housing to an outer surface of the toilet bowl, said fastening means being attached to an outer surface of said back wall of said housing, said fastening comprising a substantially adhesive material;

a sensor for detecting when the toilet seat in the upright position, said sensor comprising:

a first contact attachable to a lower surface of the toilet seat, said first contact comprising:

a plate for contacting the top wall of the housing, said plate having an upper surface and a lower surface, a peripheral edge of said plate extending between said upper and lower surfaces of said plate, said plate comprising a substantially magnetized material;

a protruding member extending away from said peripheral edge of said plate, said protruding member having a length equal to a length of said plate, said protruding member having a thickness approximately half a thickness of said plate;

a first magnetic member being mounted in said contact portion and between said upper and lower surfaces of said contact portion;

a securing means for securing said protruding member to a lower surface of the toilet seat, said securing means being attached to an upper surface of said protruding member, said securing means comprising an adhesive material;

a second contact being mounted on said housing, said second contact comprising:

a second magnetic member being attached to a lower surface of said top wall of said housing, said second magnetic member being in magnetic communication with said first magnetic member;

wherein said sensor detects the toilet seat being left in the upright position, wherein said first magnetic member is positioned away from said second magnetic member breaking magnetic communication between said first and second magnetic members;

control circuitry for controlling the alarm system, said control circuitry being electrically connected to said second contact;

a sound emitter for audibly signaling that the toilet seat has been left in the upright position, said sound emitter being mounted in said housing and positioned generally adjacent to said front wall of said housing, said sound emitter being electrically connected to said control circuitry, said sound emitter comprising a speaker;

a plurality of switches for controlling said alarm system, each of said switches being mounted in said housing and extending through one of said side walls of said housing, said plurality of switches comprising:

a power switch for providing power from said power supply to said control circuitry, said power switch being electrically connected to said power supply and said control circuitry;

a volume switch for controlling the volume of said sound emitter, said volume switch being electrically connected to said control circuitry;

a tone switch for controlling the type of tone emitted from said sound emitter, said tone switch being electrically connected to said control circuitry.

* * * * *